US005683522A

United States Patent [19]

Joesten

[11] Patent Number: 5,683,522

[45] Date of Patent: Nov. 4, 1997

[54] PROCESS FOR APPLYING A COATING TO A MAGNESIUM ALLOY PRODUCT

[75] Inventor: Leonard S. Joesten, Rockford, Ill.

[73] Assignee: Sundstrand Corporation, Rockford, Ill.

[21] Appl. No.: 413,553

[22] Filed: Mar. 30, 1995

[51] Int. Cl.[6] ..... C23C 22/22

[52] U.S. Cl. ..... 148/253; 148/275

[58] Field of Search ..... 148/275, 253

[56] References Cited

U.S. PATENT DOCUMENTS

| | | | |
|---|---|---|---|
| 1,709,894 | 4/1929 | Burdick | 148/275 |
| 1,947,122 | 2/1934 | Burdick | 148/253 |
| 2,067,216 | 1/1937 | Thompson | 148/275 |
| 2,288,995 | 7/1942 | De Long | 148/275 |
| 2,332,487 | 10/1943 | Loose | 148/275 |
| 2,665,231 | 1/1954 | Leslie | 148/253 |
| 3,419,440 | 12/1968 | Rinaldo | 148/253 |
| 3,887,449 | 6/1975 | Baer | 204/148 |
| 3,998,779 | 12/1976 | Baer | 260/37 |
| 4,976,830 | 12/1990 | Schmeling et al. | 204/58.4 |
| 4,978,432 | 12/1990 | Schmeling et al. | 204/58.4 |
| 5,383,982 | 1/1995 | Hauffe et al. | 148/262 |

FOREIGN PATENT DOCUMENTS

| | | | |
|---|---|---|---|
| 5070970 | 3/1993 | Japan | 148/253 |
| 522681 | 6/1940 | United Kingdom | 148/253 |

OTHER PUBLICATIONS

David Hawke and K. L. Albright, Hydro Magnesium, Southfield, Michigan, "A Phosphate–Permanganate Conversion Coating for Magnesium", Metal Finishing, Oct. 1995, pp. 35–38.

*Primary Examiner*—Sam Silverberg
*Attorney, Agent, or Firm*—Kristin L. Chapman

[57] ABSTRACT

This invention relates to a non-electrolytic process for applying a paint adherent and corrosion resistant coating of magnesium phosphate and magnesium fluoride to a product formed from a magnesium alloy. The process includes immersing the magnesium alloy product in a solution having phosphate and fluoride ions. The process may further include controlling a pH level of the solution, providing the solution in which the magnesium alloy product is immersed with a concentration by weight of sodium bifluoride, and controlling the solution at a certain temperature, while the magnesium alloy product is immersed for a determined period of time.

3 Claims, 1 Drawing Sheet

PROCESS FOR APPLYING A COATING TO A MAGNESIUM ALLOY PRODUCT

FIELD OF THE INVENTION

This invention relates to a process for applying a paint adherent and corrosion resistant coating to a product formed from magnesium or a magnesium alloy.

BACKGROUND ART

The design and manufacture of aircraft generator and gearbox components are subject to increasingly stringent weight and size requirements, in addition to rigorous environmental operating conditions. Magnesium alloy housings are often used to encase such generator and gearbox components, because a reduction in weight is achieved over other metals such as aluminum or iron. However, each magnesium alloy housing requires a coating to provide corrosion resistance against oils, solvents, and other environmental conditions (i.e. humidity, salt spray, fungus) inherent in the operation of the aircraft generator components, and to provide a substrate to which paint will adequately adhere without subsequently delaminating.

One mechanism for coating a metal housing which furthers these objectives includes using what is referred to in the art as a conversion coating. A conversion coating alters the chemistry of an outer layer of the base metal, by applying a thin layer of material which merges with the base metal to form a coating. Common practice in the industry includes using a chromate-based chemistry for the conversion coating. While chromate-based coatings provide reliable paint adhesion and corrosion resistance characteristics for magnesium products, chromium compounds utilized in the process are carcinogenic, and known environmental hazards. While the use of these chromium compounds has not yet been totally eliminated, federal and state environmental regulations are stringently curtailing their use in manufacturing processes; thus, a need in the industry has been recognized to develop alternatives for surface treatments of magnesium housings which do not pose an environmental hazard.

Another method of coating a metal housing which is known in the art includes anodizing the surface of a metal housing to form an oxide coating which is produced from an aqueous solution. An example of such an electrolytic process is disclosed in U.S. Pat. No. 4,978,432 to Schmeling et al. While some anodizing solutions utilize aqueous solutions, many also contain chromium compounds of which the environmental disadvantages are discussed above. With an electrolytic process, the oxide coating forms faster on the surface of the metal than with conversion coatings, and also tends to coat more rapidly where the current is directly applied. Thus, with complex shapes, as in the case of aircraft generator housings, non-uniform coatings are formed from the process of anodizing, as internal areas on the housing are either left uncoated or extremely thin, while other areas near the current application exhibit excess build-up of coating. In addition to forming non-uniform coatings, an electrolytic process does not tolerate dissimilar metals being in contact with a magnesium product during the coating step. This creates a problem in aircraft housings because steel liners, which are used to locate subsequent machining dimensions therefrom, are inserted early in the manufacturing of the part. Such inserts must be masked during the anodizing process, and when the mask is removed, an area of magnesium surrounding the insert is left uncoated.

Accordingly, it is an object of the present invention to provide a non-electrolytic process for applying an environmentally friendly conversion coating, which has advantageous paint adhesion and corrosion resistance properties, to a magnesium alloy housing, and thus, overcomes the above-referenced problems.

SUMMARY OF THE INVENTION

More specifically, this invention relates to a non-electrolytic process for applying a paint adherent and corrosion resistant coating of magnesium phosphate and magnesium fluoride to a product formed from a magnesium alloy. The process includes immersing the magnesium alloy product in a solution having phosphate and fluoride ions.

Preferably, the process may further include controlling a pH level of the solution in a range of 5 to 7, and providing the solution in which the magnesium alloy product is immersed with a concentration by weight of sodium bifluoride at a concentration of about 0.3–0.5% by weight of sodium bifluoride. Additionally, the immersing solution may be controlled at a certain temperature, while the magnesium alloy product is immersed for a determined period of time.

The process may further include various steps of degreasing the magnesium alloy product in an aqueous-based degreasing solution, cleaning the magnesium alloy product in a highly alkaline aqueous-based cleaning solution, and deoxidizing the magnesium alloy product in a deoxidizing solution.

BRIEF DESCRIPTION OF THE DRAWINGS

While the specification concludes with claims particularly pointing out and distinctly claiming that which is regarded as the present invention, the organization, the advantages, and objects of the invention may be readily ascertained by one skilled in the art from the following detailed description when read in conjunction with the accompanying drawings in which:

DESCRIPTION OF PREFERRED EMBODIMENTS

Figure 1:
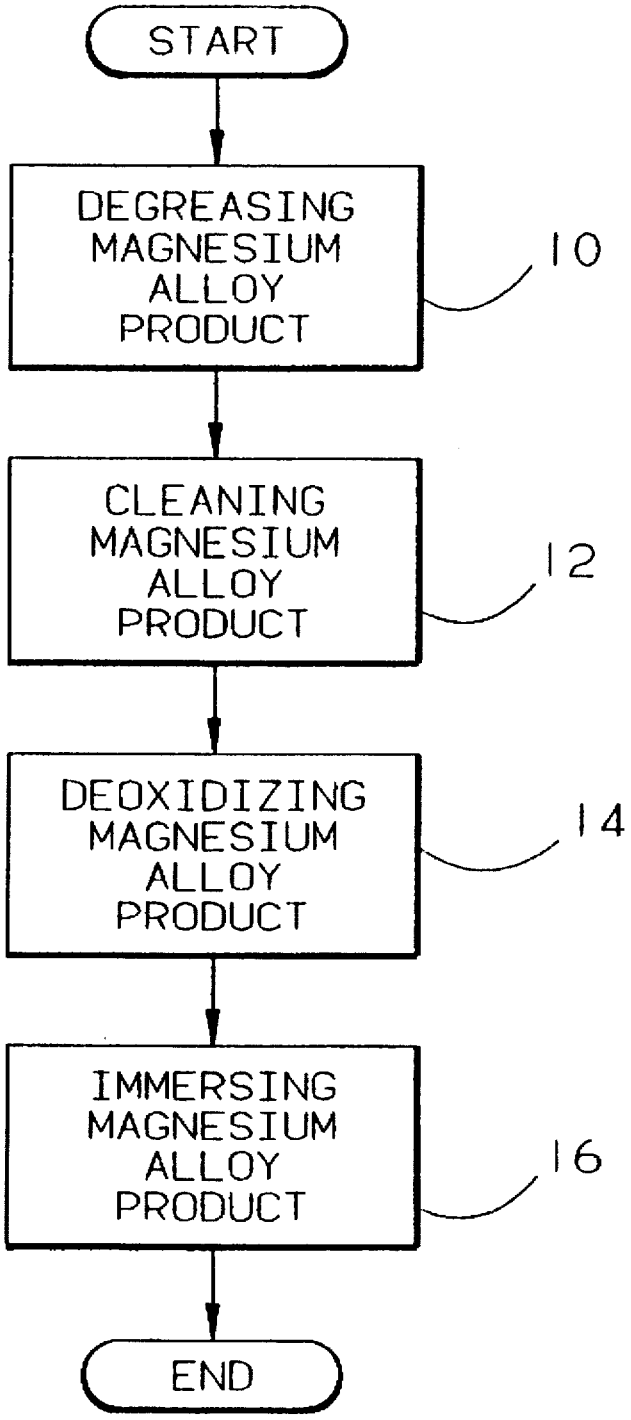
FIG. 1 is a process flow diagram of an embodiment of the instant invention illustrating a non-electrolytic process for applying a paint adherent and corrosion resistant coating to a product formed from a magnesium alloy.

FIG. 1 illustrates a process flow diagram for a non-electrolytic process for applying a paint adherent and corrosion resistant coating to a product formed from magnesium or a magnesium alloy. In the aircraft industry, for example, the magnesium alloy product may include any number of operational components such as generator housings or gearbox components.

The non-electrolytic process may begin with an initial step 10 of degreasing the magnesium alloy product in an aqueous-based degreasing solution. An aqueous-based solution, such as that commonly known and sold in the industry under the trademark Oakite™ SC 225, may be used to serve the function of degreasing the magnesium product. This initial step 10 allows for removal of oils and other contaminants on the surface of the magnesium which can subsequently prevent wetting of the surface of a housing, and inhibit the chemical reaction if not removed. One skilled in the art can appreciate that other organic solvents, such as that known in the industry and sold under the label, Blue Gold Industrial Cleaner which is manufactured by Carroll Company, or halogenated solvents such as 1,1,1-trichloroethane may also serve the degreasing function.

In addition to the degreasing step 10, the non-electrolytic process may include cleaning the magnesium alloy product in a highly alkaline aqueous-based cleaning solution in a cleaning step 12. An example of a highly alkaline cleaner which may be utilized in the cleaning step 12 is known and sold in the industry under the trademark Turco Alkaline Rust Remover™, and manufactured by Turco Products, Inc. Preferably, during the cleaning step 12, the alkaline bath of cleaning solution is continuously agitated while in use, and maintained at a temperature in a range of approximately 180–200 degrees Fahrenheit. In addition, in order to achieve an optimum cleaning effect, the concentration of the cleaning solution may be provided at approximately 20–30 ounces of highly alkaline cleaner per gallon of cleaning solution, with the cleaning solution having a pH of at least 11. By controlling the variables of concentration and pH of the cleaning solution, a preferable cleaning effect may be achieved while immersing the magnesium alloy product in the cleaning solution for a period of approximately 3–5 minutes. The cleaning step 12 further removes impurities from the surface of the magnesium alloy product which could inhibit the chemical reaction necessary to form the conversion coating of the instant invention.

If a magnesium alloy product has previously had a conversion coating applied, such as one described in the background of the instant invention based on a chromate chemistry, it may be advantageous to remove the prior chromate coating to prevent the phosphate-based chemistry of the instant invention from being limited to react with the surface of the magnesium alloy product. A procedure for chromate coating removal may include providing a chromate removal bath having a concentration of approximately 3.5–7.0 ounces of sodium acid fluoride per gallon of chromate removal bath at a temperature of approximately 70–90 degrees Fahrenheit. Preferably, the chromate removal bath is not agitated, and should be used in conjunction with the highly alkaline cleaner of the cleaning step 12 to remove the chromate residue from previously formed coatings.

The non-electrolytic process of the instant invention may further include a deoxidizing step 14 which includes deoxidizing the magnesium alloy product in a deoxidizing solution. One solution for effectively deoxidizing may be formulated from sodium acid fluoride, with a concentration of the deoxidizing solution being provided at approximately 3.5 –7.0 ounces of sodium acid fluoride per gallon of deoxidizing solution, and a temperature of the solution being maintained at approximately 70–90 degrees Fahrenheit. Preferably, the deoxidizing solution is not agitated while deoxidizing the magnesium alloy product for an optimum period of time of approximately 3–5 minutes. As one skilled in the art may appreciate, the deoxidizing solution has similar characteristics to the chromate removal bath, if a chromate removal bath is used; however, the use of separate baths is preferred if both steps are taken because the result is a cleaner magnesium alloy product. The deoxidizing step 14 effectively removes any metal oxides which are present on the surface of the magnesium alloy housing and which inhibit the chemical reaction of the phosphate conversion coating from occurring.

One skilled in the art can appreciate other solutions, with properties comparable to those disclosed, may accomplish the initial, cleaning, and deoxidizing steps 10, 12, and 14, respectively. For example, the deoxidizing solution of the deoxidizing step 14 may include a solution of nitric acid and hydrofluoric acid. However, because hydrofluoric acid combined with nitric acid is such a strong reactant, its application may be limited when personnel safety is at issue, or when dimensions of the magnesium alloy product are critical to maintain tight tolerances, as a combination of hydrofluoric/nitric acid reacts very strongly on magnesium and may attack the actual surface of the magnesium product.

The non-electrolytic process of the instant invention further includes an immersing step 16. The immersing step 16 involves immersing the magnesium alloy product in a solution having phosphate and fluoride ions. As both phosphate and fluoride ions are negatively-charged anions, each attract positively-charged cations of magnesium which permeate the surface of the housing. The phosphate and fluoride ions react with the magnesium ions to form a conversion coating of magnesium phosphate ($Mg_3(PO_4)_2$) and magnesium fluoride ($MgF_2$) on the surface of the magnesium alloy housing.

Preferably, the immersing step 16 includes controlling a pH level of the solution in a range of 5 to 7. By controlling the pH level of the immersing solution, the phosphate ions will react with the magnesium alloy surface to form a coating which includes magnesium phosphate, as a certain amount of acidity is needed for phosphate to react with magnesium. If indeed the pH of the solution is kept at an alkaline (high) level, little, if any, reaction will occur with the magnesium alloy product to form a conversion coating. If the pH of the solution is kept too low, at an acidic level, the phosphate will massively attack the magnesium alloy and instigate corrosion before a coating has had a chance to form on the surface. Also, if the pH level is kept too low, a coating may form which is excessively high in fluoride content via magnesium fluoride. Such a coating will have poor adhesion qualities for an organic coating.

One skilled in the art may readily appreciate a controlled pH may be provided through a phosphate compound such as monobasic potassium phosphate ($KH_2PO_4$), dibasic potassium phosphate ($K_2HPO_4$), tribasic potassium phosphate ($K_3PO_4$), or phosphoric acid ($H_3PO_4$), or combinations of these alternatives. A preferred embodiment to achieve the desired immersing solution pH level of the instant invention includes combining monobasic potassium phosphate, at a nominal concentration by weight of approximately 1.8 ounces per gallon of solution, with dibasic potassium phosphate, at a nominal concentration by weight of approximately 3.6 ounces per gallon of solution. This combination allows the preferred pH level of the immersing solution to be controlled in an optimum slightly acidic range.

In addition to a controlled pH, the solution of the immersing step 16 is also provided with an optimum amount of fluoride ions in the solution which will adequately react with the surface of the magnesium alloy housing to form a coating of magnesium fluoride. Preferably, the amount of fluoride ions is measured in terms of a concentration by weight of sodium bifluoride ($NaHF_2$). In a preferred embodiment, the concentration is provided at about 0.3–0.5% by weight sodium bifluoride; this range of concentrations may be achieved by using a nominal concentration by weight of sodium bifluoride of about 0.4–0.7 ounces per gallon of solution, respectively. This controlled concentration of fluoride via sodium bifluoride allows a magnesium fluoride conversion coating to form on the surface of the magnesium alloy product on which paint will adequately adhere. If a solution is used which has too high of a fluoride component, poor paint adhesion characteristics will result on the surface of the magnesium.

One skilled in the art may appreciate, other fluoride compounds, such as potassium fluoride or hydrofluoric acid, may be used to introduce fluoride ions into the immersing solution, and conversions may be used to equate such a fluoride compound concentration to an equivalent concentration level measured in terms of sodium bifluoride.

In a preferred embodiment of the immersing step 16, it is extremely advantageous to maintain the solution at a temperature of approximately 130 degrees Fahrenheit, while the magnesium alloy product is immersed in the solution for a period of approximately thirty minutes. However, one skilled in the art can appreciate that the desired effect of a conversion coating may be achieved within a range of optimum temperatures (i.e. 120–140 degrees Fahrenheit) over a range of periods of minutes (i.e. 25–50 minutes), depending on the desired production time.

By following the steps 10, 12, 14 and 16 in accordance with the disclosed process, one skilled in the art may readily apply a magnesium phosphate and magnesium fluoride coating to a magnesium alloy product which is both corrosion resistant and paint adherent; that is to say, paint readily adheres to the surface of the magnesium alloy which has been coated in accordance with the instant invention. The adequacy of paint adhesion characteristics may be tested by employing a dry adhesion test after the coated magnesium alloy product has been painted. The dry adhesion test includes applying a one-inch strip of highly adhesive tape, such as that known and sold in the industry under the trademark 3M™ #250. The highly adhesive tape is pressed down firmly to insure continuous contact with the painted surface of the magnesium alloy product. The tape is then removed in a single abrupt motion perpendicular to the surface of the magnesium alloy product. No voids of paint film should be apparent. The painted coated surface of magnesium may also be tested for paint adherence under wet adhesion conditions. This wet adhesion test includes applying a piece of cloth saturated with deionized water to an area on the surface to be tested, and covering the wet cloth with a film of polyethylene, and sealing the edges of the saturated cloth with tape. After twenty-four hours, the wet cloth is removed, the surface is wiped dry, and the dry adhesion test is performed. Once again, no voids of paint film should be apparent. One skilled in the art may readily appreciate, that the process of the instant invention for coating a magnesium alloy product provides a mechanism to treat a magnesium surface to provide favorable paint adherent characteristics.

While it is advantageous to remove a prior chromate conversion coating as discussed above for contamination reasons, it is not necessary to remove a phosphate/fluoride-based conversion coating which has been applied in accordance with the disclosed invention before applying an additional phosphate/fluoride-based conversion coating in accordance with the disclosed steps 10, 12, 14 and 16. With either environment, under high magnification of a scanning electron microscope, no defects or irregularities should appear in the coating, if steps 10, 12, 14 and 16 have been followed properly, and the coating should possess a porous, bead-like structure.

Often in aircraft operational components, an electrical resistance of 0.5 milliohms or less is required for a conversion coating to insure electrical signals can conduct across interfaces of various aircraft generator parts. One skilled in the art may appreciate the phosphate/fluoride-based conversion coating of the instant invention meets this electrical resistance requirement, either through a single layer coating or with a double layer coating.

Numerous modifications in the alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A non-electrolytic process for applying a paint adherent and corrosion resistant coating of at least magnesium fluoride to a product formed from a magnesium alloy, comprising the steps of:

degreasing the magnesium alloy product in an aqueous-based degreasing solution;

cleaning the magnesium alloy product in a highly alkaline aqueous-based cleaning solution;

deoxidizing the magnesium alloy product in a deoxidizing solution; and immersing the magnesium alloy product in a solution having phosphate and fluoride ions wherein a pH level of the solution is controlled in an approximate range of 5 to 7, the solution being provided with a concentration by weight of sodium bifluoride at a concentration of about 0.3–0.5%, and being maintained at a temperature of approximately 130 degrees Fahrenheit while immersing the magnesium alloy product for a period of approximately thirty minutes.

2. A non-electrolytic process for applying a paint adherent and corrosion resistant coating of at least magnesium phosphate and magnesium fluoride to a product formed from a magnesium alloy, comprising the steps of:

degreasing the magnesium alloy product in an aqueous-based degreasing solution;

cleaning the magnesium alloy product in a highly alkaline aqueous-based cleaning solution;

deoxidizing the magnesium alloy product in a deoxidizing solution; and immersing the magnesium alloy product in a solution having phosphate and fluoride ions wherein a pH level of the solution is controlled in an approximate range of 5 to 7, the solution being provided with a concentration by weight of sodium bifluoride at a concentration of about 0.3–0.5% and being maintained at a temperature of approximately 130 degrees Fahrenheit while immersing the magnesium alloy product for a period of approximately thirty minutes.

3. A non-electrolytic process for applying a paint adherent and corrosion resistant coating of at least magnesium phosphate to a product formed from a magnesium alloy, comprising the steps of:

degreasing the magnesium alloy product in an aqueous-based degreasing solution;

cleaning the magnesium alloy product in a highly alkaline aqueous-based cleaning solution;

deoxidizing the magnesium alloy product in a deoxidizing solution; and immersing the magnesium alloy product in a solution having phosphate and fluoride ions wherein a pH level of the solution is controlled in an approximate range of 5 to 7, the solution being provided with a concentration by weight of sodium bifluoride at a concentration of about 0.3–0.5% and being maintained at a temperature of approximately 130 degrees Fahrenheit while immersing the magnesium alloy product for a period of approximately thirty minutes.

* * * * *